US005692807A

United States Patent [19]

Zimmerman

[11] Patent Number: 5,692,807

[45] Date of Patent: Dec. 2, 1997

[54] HIGHWALL MINING APPARATUS

[75] Inventor: Joseph J. Zimmerman, Franklin, Pa.

[73] Assignee: Joy MM Delaware, Inc., Wilmington, Del.

[21] Appl. No.: 501,741

[22] Filed: Aug. 9, 1995

[51] Int. Cl.[6] ..... E21C 29/00; E21C 35/20

[52] U.S. Cl. ..... 299/67; 299/56

[58] Field of Search ..... 299/67, 64, 18, 299/56, 57; 198/584, 586, 589, 592

[56] References Cited

U.S. PATENT DOCUMENTS

| | | | |
|---|---|---|---|
| 10,817 | 4/1854 | Field . | |
| Re. 31,622 | 7/1984 | Todd | 299/1 |
| 2,165,666 | 7/1939 | Tilly | 255/20 |
| 2,780,451 | 2/1957 | Alspaugh et al. | 262/7 |
| 2,826,402 | 3/1958 | Alspaugh et al. | 262/26 |
| 2,872,170 | 2/1959 | Alspaugh et al. | 262/26 |
| 2,979,318 | 4/1961 | Haspert et al. | 262/7 |
| 3,135,502 | 6/1964 | Muehlman | 262/26 |
| 3,180,280 | 4/1965 | Kuch et al. | 104/245 |
| 3,301,602 | 1/1967 | Heimaster | 299/64 |
| 3,362,752 | 1/1968 | Densmore | 299/18 |
| 3,391,652 | 7/1968 | Lauber | 104/247 |
| 3,397,651 | 8/1968 | Biedess | 104/244.1 |
| 3,574,405 | 4/1971 | Shimuda | 299/64 |
| 3,746,110 | 7/1973 | Young et al. | 175/85 |
| 3,907,093 | 9/1975 | Skibo | 198/10 |
| 3,942,720 | 3/1976 | Crutchfield | 238/4 |
| 4,036,529 | 7/1977 | Hawthorne et al. | 299/19 |
| 4,059,163 | 11/1977 | Stedman | 175/73 |
| 4,264,106 | 4/1981 | Deeter et al. | 299/56 |
| 4,506,931 | 3/1985 | Haspert | 299/1 |
| 4,646,906 | 3/1987 | Wilcox, Jr. et al. | 198/303 |
| 4,699,429 | 10/1987 | Maybrier et al. | 299/7 |
| 4,952,000 | 8/1990 | Lipinski et al. | 299/1 |
| 5,056,655 | 10/1991 | Justice | 198/812 |
| 5,112,111 | 5/1992 | Addington et al. | 299/18 |
| 5,154,489 | 10/1992 | Lemieux | 299/18 |
| 5,190,134 | 3/1993 | Mraz | 198/589 X |
| 5,232,269 | 8/1993 | Addington et al. | 299/67 |
| 5,261,729 | 11/1993 | Addington et al. | 299/64 |
| 5,364,171 | 11/1994 | Addington et al. | 299/18 |
| 5,370,218 | 12/1994 | Johnson, Jr. et al. | 198/584 X |

*Primary Examiner*—Hoang C. Dang

*Attorney, Agent, or Firm*—Kirkpatirck & Lockhart LLP

[57] ABSTRACT

An apparatus for mining aggregate material from a partially exposed seam adjacent a bench on a surface mine and which extends from the bench at an elevation and angle relative to the bench, The apparatus includes a self-propelled mining machine for dislodging aggregate material from the seam and conveying apparatus that is attached to the self-propelled mining machine for conveying the dislodged material to a location remote from the seam. The apparatus further includes a guidance assembly for selectively orienting the mining machine and the conveying apparatus at a predetermined attack angle that corresponds to the seam angle.

21 Claims, 14 Drawing Sheets

HIGHWALL MINING APPARATUS

BACKGROUND OF THE INVENTION

1. Field of the Invention

The present invention relates to apparatuses for mining underground materials and, more particularly, is directed to apparatuses for mining coal from portions of seams that cannot be economically mined utilizing conventional surface or strip mining methods.

2. Description of the Invention Background

It has been stated that perhaps the United States' greatest natural resource is its underground coal reserves. Every year, over nine million tons of coal are mined in the United States. Such coal is then, for example, shipped to power plants wherein it is burned to provide electrical power or used for a myriad of other purposes.

There are many methods in existence for mining coal from underground seams. One method that is commonly employed for mining coal from seams that are relatively deep below the surface involves the development of underground shafts and passageways by sophisticated mining machines. As the coal is removed, shuttle cars and/or various networks of conveyors are used to convey the mined coal to the surface for eventual transport to the end user.

In locations where the coal seam is closer to the surface, another mining method known as strip or surface mining is commonly employed. Surface or strip mining involves removing the earth, rock, gravel, etc., overlying a coal seam, commonly known as "overburden", to expose the coal. However, coal seams are rarely located at a constant depth relative to the ground surface; a coal seam may be relatively close to the surface in one area and relatively deep in an other area. In those areas where the seam exceeds a certain depth, it may not be economically feasible to remove the overburden overlying the seam. When that condition occurs, the surface mining process is discontinued leaving a pit or pits having "highwalls" of overburden that overly the adjacent unmined portions of the seam.

In the past, augering systems of the types disclosed in, for example, U.S. Pat. No. 4,036,529 to Hawthorne et al., U.S. Pat. No. 4,089,163 to Stedman and U.S. Pat. No. 4,699,429 to Maybrier et al. have been used to remove coal that could not be economically mined or won utilizing conventional surface mining techniques. Such augering systems typically include a drive unit that is arranged adjacent the highwall. A series of auger bits forming a bit string are attached to the drive unit which serves to rotate and force the string of auger bits into the seam. As the bit string is rotatably advanced into the seam, the coal is dislodged by cutting devices on the first bit and is augered rearwardly out of the hole to a conveying apparatus for discharge into a truck or other vehicle. As additional auger bits are added to the string, the frictional resistance to the rotation of the string increases due to the overall weight of the string and the amount of coal being conveyed thereby. Thus, most augering systems can seldom penetrate a seam further than 250 feet.

In an effort to address the shortcomings associated with augers, other highwall mining systems have been developed. For example, U.S. Pat. Re. No. 31,622 to Todd discloses a mining system that includes a cutting head that is adapted to be forced into the coal seam by an elongated conveying column. The conveying column comprises a series of interconnected thrust transmitting enclosures that each house two auger conveyors. A power head is located adjacent to the highwall and is adapted to apply a thrusting force to the rearwardmost module which causes the cutting head to be advanced into the seam.

Still other mining systems have been developed for mining coal from highwalls created during surface mining operations. For example, U.S. Pat. No. 3,362,752 to Densmore discloses a mining apparatus that employs a self-propelled mining machine that is attached to a series of conveyor pipes for pneumatically transmitting the won coal to a discharge conveyor on a mobile platform located adjacent the highwall. In another embodiment disclosed in U.S. Pat. No. 3,362,752, a rack and pinion drive arrangement is mounted to the mobile platform for thrusting the conveyor pipes and a mining machine, which is not self-propelled, into the seam.

Another highwall mining system is disclosed in U.S. Pat. No. 2,872,170 to Alspaugh. This system includes a remote controlled self-propelled mining machine that pulls a series of interconnected cascading belt conveyors into a seam to be mined. The belt conveyors receive the won coal from the mining machine and discharge it onto a conveyor attached to a launching platform located adjacent the highwall. As the mining machine advances into the seam, the train of conveyors is lengthened by adding additional conveyors. Thus, the amount of penetration that can be achieved by such system is dependant upon the weight of the conveyor train that the mining machine must pull.

A similar mining system is disclosed in U.S. Pat. No. 3,135,502 to Muehlman. However, the conveyors of the Muehlman system are self-propelled to aid the mining machine's advancement into the seam. Also, the train of conveyors is stored on a spiral storage track mounted to a launching platform located adjacent the highwall. Muehlman teaches that the forward thrust of the mining machine is assisted by gravity acting on the elevated conveyor train located on the spiral track. However, the length of the conveyor train is limited by the amount of storage capacity provided on the spiral track.

Other highwall mining apparatuses are disclosed in U.S. Pat. Nos. 5,112,111, 5,232,269, 5,261,729, and 5,364,171 to Addington et al. These patents show a highwall mining system that includes a self-propelled mining machine that is adapted to pull a series of interconnected cascading belt conveyors into the seam. A launch vehicle that is equipped with a conveyor for receiving and conveying aggregate from the conveyor train and a drive means, such as hydraulic cylinders, for advancing and withdrawing the conveyor train is also shown in these patents. The Addington patents state that the launch vehicle is also equipped with means for adding conveyors to the conveyor train without interrupting the conveying process. U.S. Pat. No. 5,232,269 shows that the launch vehicle may be equipped with an extensible front end which comprises a series of track members that are adapted to support the mining machine or conveyor units of the conveyor train. The track members are received in sliding, interdigitating engagement with a second series of cooperating track members held stationary on the frame of the launch vehicle. A pair of cylinders serve to extend and retract the first set of tracks. This patent also indicates that a guide track is provided on the launch vehicle for aligning the conveyor modules supported on the launch vehicle with the conveyor .attached to the launch vehicle.

Regardless of the type of system that is employed, all of the above-described systems include a variety of equipment and components that must be hauled to the mine site and assembled prior to use. Moreover, the system must be capable of being moved to adjacent locations along the highwall in accordance with a predetermined mining scheme. The systems described above, due to the size and construction of their respective drive units, launch vehicles, and/or other peripheral equipment such as conveyors, air compressors, water pumps, generators, etc. are typically expensive and time consuming to transport and assemble at the mine sight. In addition, depending upon the size of some of those systems' components, special "oversized" travel permits must be obtained to haul the components on various highways. Thus, there is a need for a highwall mining system that utilizes modular components capable of being easily assembled and dissembled to reduce the transportation costs commonly associated with transporting prior highwall mining systems from mining site to mining site.

Also, in a number of highwall mining arrangements it is not unusual for the seam to angle downward or upward from the bench on which the power unit or launch vehicle is supported. Regardless of the type of highwall mining apparatus employed, the mining machine and conveying units must be properly aligned with the seam before the mining process can be commenced. Over the years, a number of conveyor guidance mechanisms and arrangements have been developed for guiding conveyor trains and haulage vehicles within a seam. For example, U.S. Pat. No. 3,301,602 to Heimaster et al. discloses a conveyor guidance system that comprises a cutting bar that is attached to the rear of a continuous mining machine. Each conveyor has a set of steerable wheels adapted to ride on the mine floor and a wheeled guidance member adapted to ride in the groove. The conveyor train is guided in a path defined by the groove created by the mining machine. However, the groove is susceptible to collecting dust and debris and/or collapsing after continuous use.

Another wheeled guidance system is taught in U.S. Pat. No. 3,391,652 to Lauber which includes guidance wheels mounted to a train car. The guidance wheels are adapted to engage ground-mounted rails and serve to retain the train car on the rails. Such guidance means is ill-suited for highwall mining purposes because the tracks would have to be installed as the mining machine advances into the seam. To do so, the conveying train would have to be removed from the mined hole each time a new section of track is laid.

U.S. Pat. No. 4,059,163 to Stedman discloses an auger system that includes a support structure that is mounted on a pair of rails mounted adjacent and parallel to the highwall. A drive carriage that has two sets of rollers attached thereto is received on the support structure. The drive carriage rollers are trapped within rails attached to the support structure to guide the carriage on the structure. The auger sections are each housed in a cylindrical shroud which serves as a conduit for conveying the mined coal. Rollers are mounted to the support structure and are adapted to engage the Shroud of each auger section when it is received on the support structure. While such roller arrangement serves to support the auger sections that are received on the support structure, the apparatus is ill-suited for aligning and guiding the auger sections into a seam. Also, as mentioned above, U.S. Pat. No. 5,232,269 to Addington et al. discloses a launch vehicle that has an extensible front end portion that permits the launch vehicle to be operated on relatively narrow benches. While that extensible front end can serve as a stable floor for supporting a conveyor unit of the conveyor train, such front end is not equipped with guide means for guiding the conveyor or mining machine into the seam.

Thus, there is a need for a highwall mining system that can be transported from mine site to mine site on standard over-the-highway vehicles.

There is a further need for a highwall mining apparatus that is equipped with means for quickly aligning the mining and conveying apparatus with a seam.

There is yet another need for a highwall mining apparatus for providing accurate and rigid guidance of the mining machine and conveyor cars as they leave the launch platform to begin mining a new entry into a seam.

SUMMARY OF THE INVENTION

In accordance with a particular preferred form of the present invention, there is provided an apparatus for mining aggregate material from a partially exposed seam that is adjacent to a bench on a surface mine and which extends from the bench at an elevation and angle relative to the bench. A preferred form of the apparatus includes a self-propelled mining machine for dislodging aggregate material from the seam. The apparatus also includes conveying apparatus that is attached to the self-propelled mining machine for conveying the dislodged material to a location remote from the seam. The apparatus further includes a guidance assembly that is supportable on the bench. The guidance assembly selectively orients the mining machine and the conveying apparatus at a predetermined attack angle that corresponds to the seam angle.

It is an object of the present invention to provide means for selectively orienting and aligning a mining machine and its accompanying conveyor train at an entry or "attack" angle that corresponds to a seam angle.

Another object of the present invention is to provide a highwall mining apparatus that can be hauled from mine site to mine site on standard over-the-highway vehicles.

Still another object of the present invention is to provide a launching platform that employs standard over-the-highway tractor trailer containers for housing various system components therein.

Another object of the present invention is to provide a launching platform that can be easily maneuvered to various mining locations on a mine bench.

Yet another object of the present invention is to provide a launch vehicle with means for staging and adding conveying units to a train of conveying units attached to a mining machine.

Another object of the present invention is to provide a conveying unit that includes first and second portions that are pivotally interconnected together and capable of pivoting in response to undulations in the mine floor without pivoting laterally with respect to each other.

Accordingly, the present invention provides solutions to the aforementioned problems commonly associated with other highwall mining apparatuses. Those of ordinary skill in the art will readily appreciate that these and other details, objects and advantages will become apparent as the following detailed description of the present preferred embodiments thereof proceeds.

BRIEF DESCRIPTION OF THE DRAWINGS

In the accompanying drawings, there is shown present preferred embodiments of the invention wherein like reference numerals are employed to designate like parts and wherein.

DETAILED DESCRIPTION OF THE PREFERRED EMBODIMENTS

Figure 1:
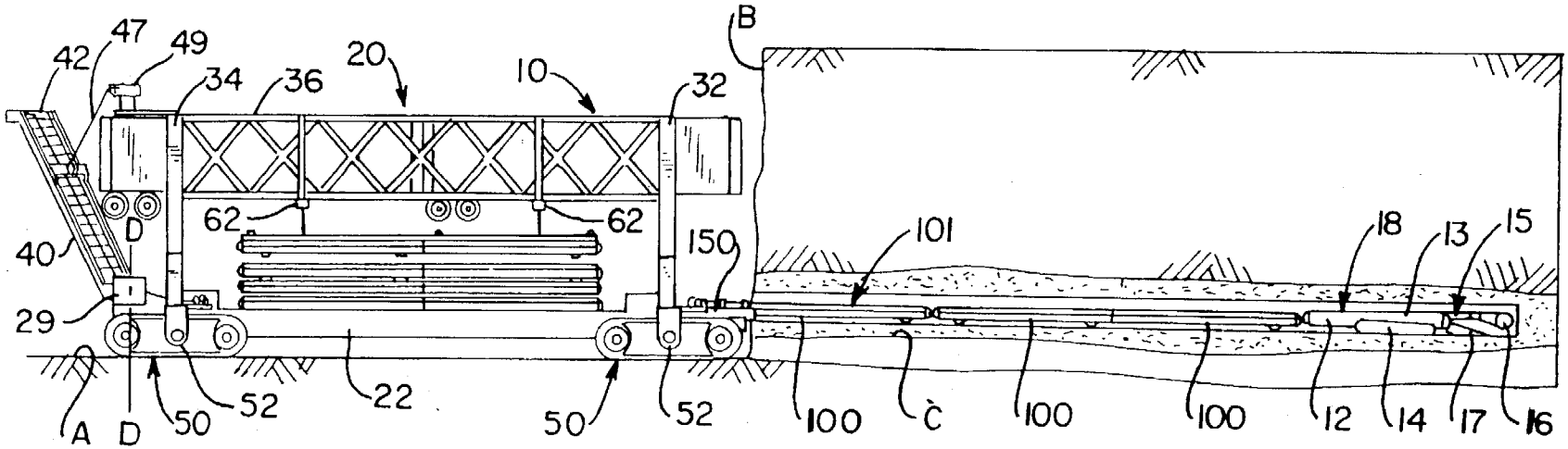
FIG. 1 is a side elevational view of a preferred highwall mining system of the present invention mining a coal seam.

Referring now to the drawings for the purposes of illustrating the present preferred embodiment of the invention only and not for purposes of limiting the same, the Figures show a highwall mining system generally designated as 10.

More particularly and with reference to FIG. 1, the present system is adapted to be located in a pit or bench "A" at the base of a highwall "B" where a coal seam "C" is exposed and available for mining. In a preferred form, the system 10 comprises a continuous mining machine 12, a launching platform, generally designated as 20, and a conveying train designated as 101 which consists of a plurality of cascading conveyor cars 100 connected in an end-to-end fashion.

The continuous mining machine 12 is known in the art. For example, exemplary examples of such mining machines are disclosed in U.S. Pat. No. 4,486,051 to Becker and U.S. Pat. No. 3,966,258 to Dolecki. Those of ordinary skill in the art will appreciate that the mining machine 12 includes a chassis 13 that is mounted on ground engaging tracks 14. A boom assembly 15 is pivotally mounted to the chassis 13 for operably supporting a rotatable cutting drum 16. A series of mining bits are attached to the drum 16 to dislodge material from the seam. The mining machine 12 is also equipped with a gathering head 17 that collects the won coal and transfers it to a conveyor 18 that conveys the coal to the rear of the machine 12 for discharge onto a conveyor car 100 that is attached thereto.

The launching platform 20, in a preferred form, is fabricated from collection of components that can be quickly bolted or pinned together, yet when disassembled can be easily transported by conventional over-the-highway trucks. For example, each of the various disassembled superstructure components that are described below is sized such that it can be transported on a typical flat bed truck without requiring special "oversized load" permits to be obtained. The reader will appreciate that an oversized permit is typically required when the dimensions of the load exceed 8' wide×45' long×8' high.

Figure 3:
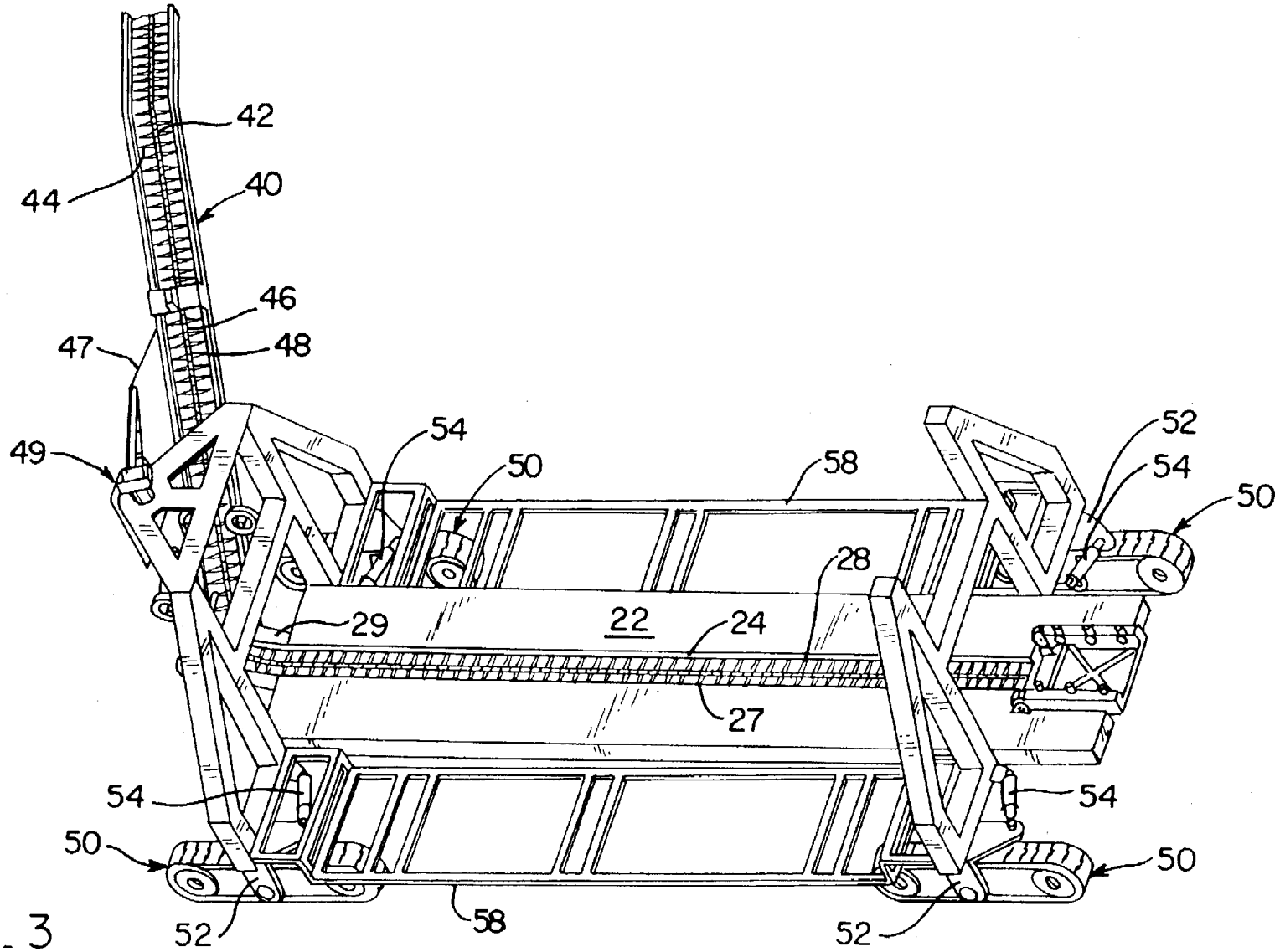
FIG. 3 is a partial plan perspective view of a preferred deck assembly of the present invention.
Figure 4:
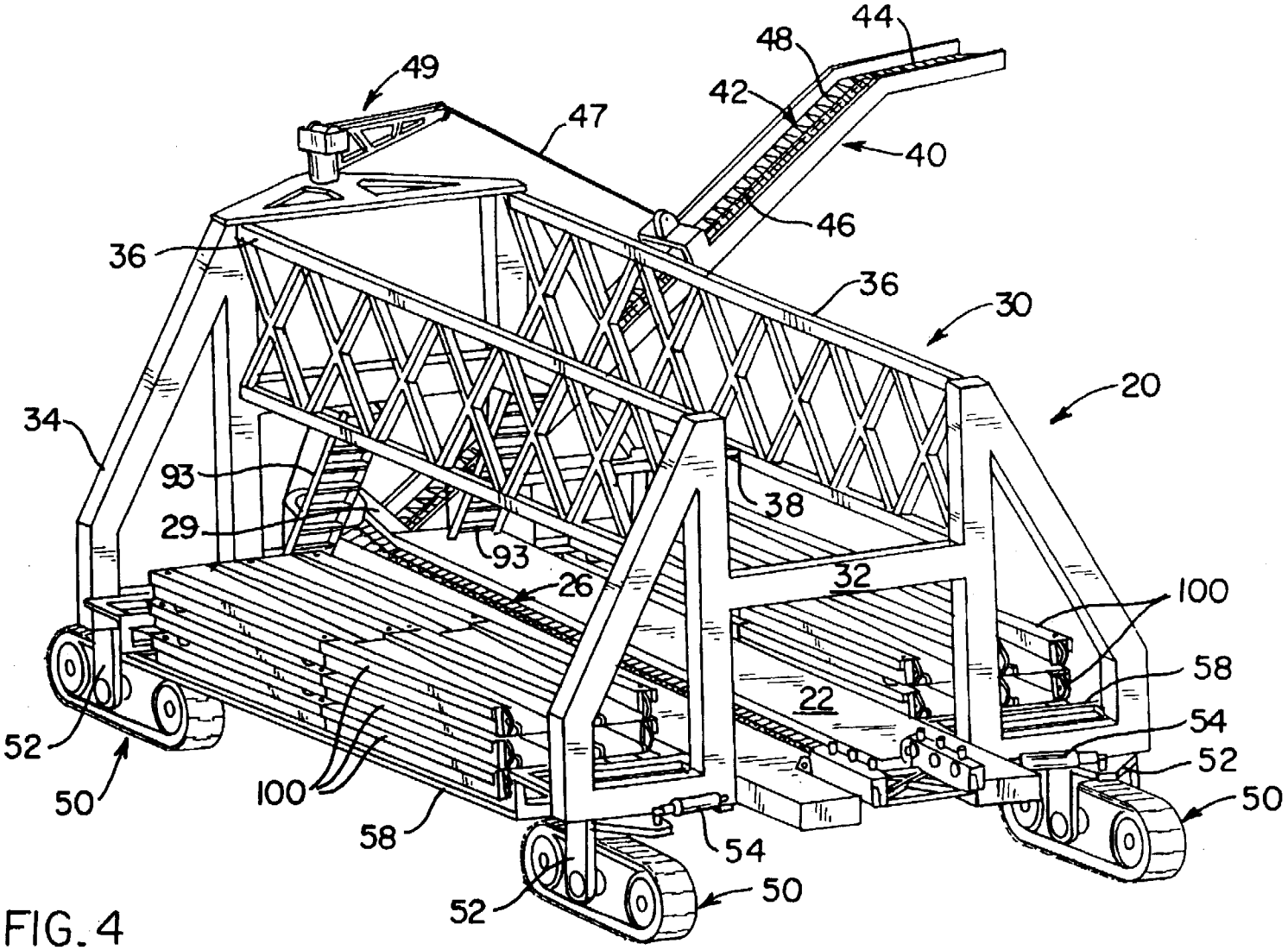
FIG. 4 is a partial front perspective view of a preferred launching platform of the subject invention with some elements thereof removed for clarity.

More particularly and with reference to FIGS. 3 and 4, the launching platform 20 comprises a deck 22 that is preferably fabricated from structural steel and is approximately seventy feet long and sixteen feet wide. A longitudinally extending conveyor trough 24 is formed along the center axis of the deck 22 and is adapted to support a chain conveyor 26 therein. The skilled artisan will appreciate that conveyor 26 includes an endless driven chain 27 that has a series of conventional scraper pads 28 attached thereto for advancing the won coal to the rear of the deck 22. Conventional means for imparting orbital movement to the chain conveyor 26 are provided on the launching platform 20.

In a preferred embodiment, a superstructure, generally designated as 30, is attached to the deck 22. As can be seen in FIG. 4, the superstructure 30 includes a front frame member 32 and a rear frame member 34. Frame members (32, 34) are preferably fabricated from steel tubing and are adapted to be bolted or pinned to the deck 22 such that the front frame member 32 is attached to the front portion of the deck 22 and the rear frame member 34 is attached to the rear of the deck 22. A pair of side members 36, preferably constructed as shown in FIG. 4, extend between the front and rear frame members (32, 34) and are bolted or pinned thereto. At least one cross brace 38 is provided between the side members 36 and is bolted thereto. The skilled artisan will appreciate that the above-described members forming the superstructure 30 are rigidly bolted or pinned together for quick assembly and disassembly. If a more permanent installation is desired, the members of the superstructure 30 may be welded together.

Figure 2:
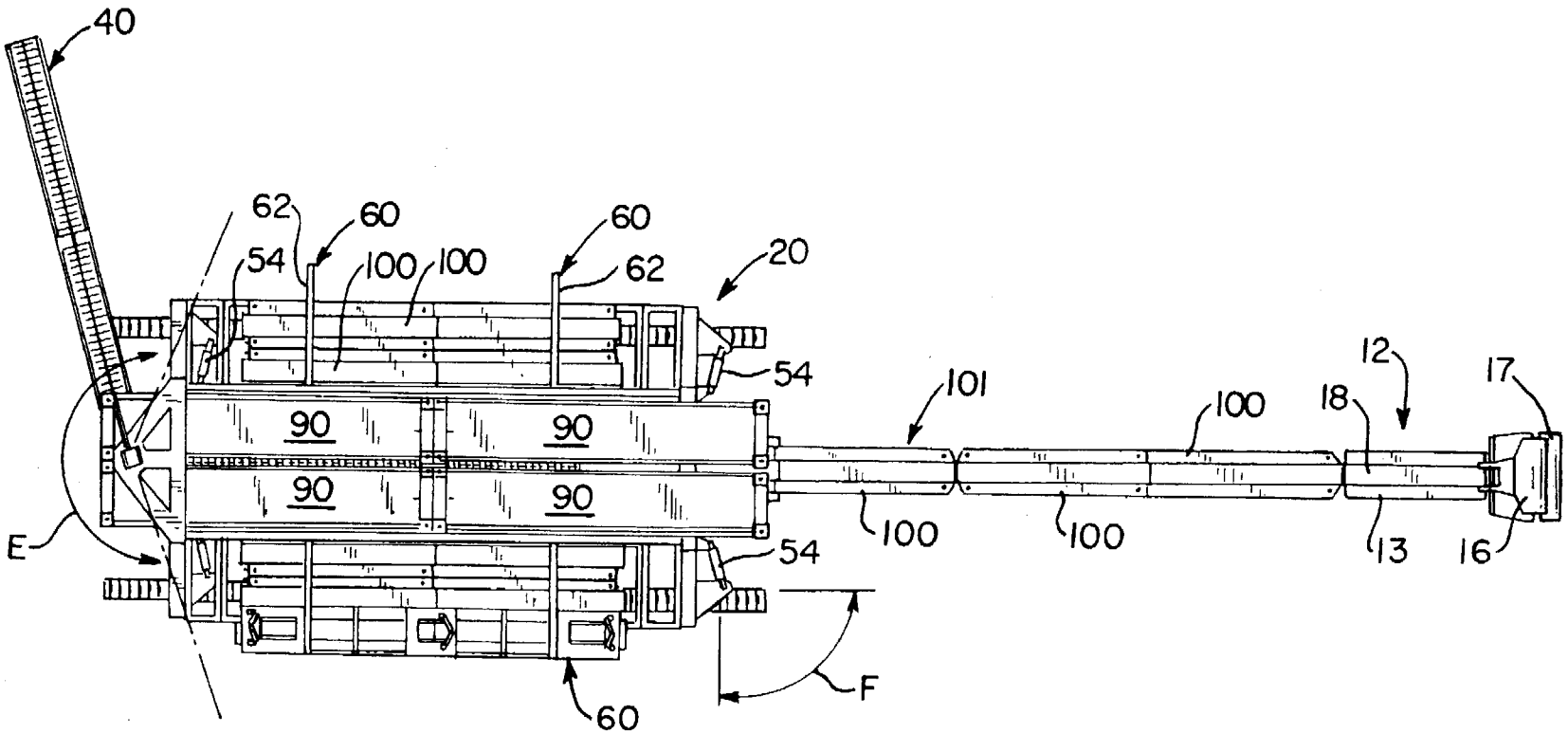
FIG. 2 is a plan view of the highwall mining system of FIG. 1.

As can also be seen in FIGS. 3 and 4, the conveyor 26 discharges won coal into a transfer bowl 29 located at the rear of the deck 22. A second discharge or "stacker" conveyor 40 is rotatably pinned to the transfer bowl 29 such that it can be selectively pivoted about axis D—D (See FIG. 1) in an approximate 220° arc (represented by arrow "E" in FIG. 2) to discharge positions on each lateral side of the launching platform 20.

Stacker conveyor 40 preferably comprises a conventional chain and scraper conveyor 42 that is similar in construction to conveyor 26. In particular, conveyor 40 includes an elongated trough 44 that supports a rotatable endless chain 46. Chain 46 is powered by a drive motor (not shown) and has scraper pads 48 attached at spaced intervals along its length. The discharge end of the stacker conveyor 40 is preferably supported by a cable 47 that is attached to a winch assembly 49 that is pivotally attached to the superstructure 30 in the manner illustrated in FIG. 4. It will be appreciated that the winch assembly 49 enables the elevation of the stacker conveyor above the bench to be selectively adjusted. The skilled artisan will further appreciate that the stacker conveyor 40 of the present invention can be selectively pivoted to various positions behind and beside the launching platform 20 to discharge the coal into a pile adjacent the rear or sides of the deck 22 or into dump trucks or other vehicles positioned around the launching platform 20.

In a preferred embodiment of the present invention, the launching platform 20 is adapted to be moved along the bench "A" by four conventional self-contained track assemblies 50 preferably of the type manufactured by Harnishfeger Industries of P.O. Box 554, Milwaukee, Wis. 53201-0554 under Model No. 1550. However, other track arrangements knwon in the art may also be successfully employed.

As can be seen in FIG. 3, two track assemblies 50 are attached to the front frame member 32 and two track assemblies are attached to the rear frame member 34. Each track assembly is operably attached to a trunion 52 that is rotatably attached to the corresponding front or rear frame member (32, 34). Also in a preferred embodiment, a hydraulic cylinder 54 is attached between each trunion 52 and the corresponding front or rear frame member (32, 34) to selectively pivot the trunion members 52 in an approximate 90° arc (represented by arrow "F" in FIG. 2). The skilled artisan will appreciate that the launching platform 20 can be steered as it is advanced along the bench "A" to adjacent mining locations by coordinating the pivotal orientations of the track assemblies 50. It will be further appreciated that the present trunion 52 arrangement enables each track assembly 50 to pivot in response to undulations in bench "A" during repositioning of the launching platform 20. Also, a hydraulic cylinder may be attached between each trunion 52 and the corresponding front or rear frame member (32, 34) to selectively adjust the elevation of the launching platform above the bench.

In a preferred embodiment, conveyor cars 100 are staged on the launching platform 20 to reduce the amount of time required to retrieve and add an addition conveyor car 100 to the end of the conveyor train 101 as it follows the mining machine 12 into the seam "C". Support structures 58 are preferably removably attached to each lateral side of the deck 22 in the manner shown in FIGS. 3 and 4. Those of ordinary skill in the art will readily appreciate that such conveyor staging arrangement enables a number of conveyor cars 100 to be moved with the launching platform 20 to various other mining positions on the bench "A".

Figure 5:
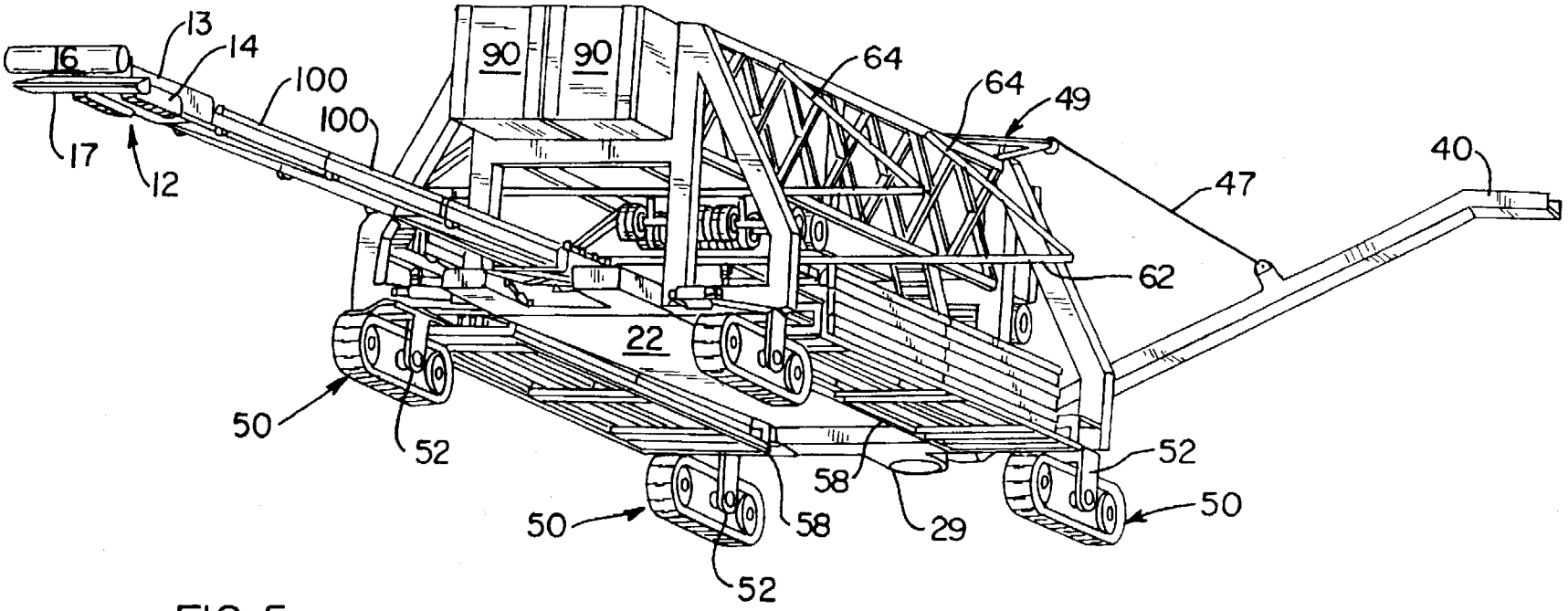
FIG. 5 is a bottom perspective view of a preferred highwall mining system of the present invention.

To facilitate the positioning of a conveyor car 100 on the deck 22 for attachment to the last conveyor car 100 in the train 101, a pair of crane assemblies 60 are preferably mounted to the launching platform 20 in the positions shown in FIG. 5. In a preferred form, each crane 60 assembly comprises a trolley rail 62 that is removably attached to the side members 36 by conventional fasteners such that the rails 62 extend over the conveyor support members 58. The outer ends of each rail 62 are supported by cross braces 64 that are removably attached to the side members 36 by bolts or pins. An electrically powered crane trolley 66 of the type manufactured by Harnishfeger Industries of P.O. Box 554, Milwaukee, Wis. 53201-0554 is preferably movably received on each rail 62. However, those of ordinary skill in the art will appreciate that other crane trolley assemblies may also be successfully used. The skilled artisan will further appreciate that each crane trolley 66 can be selectively moved on its corresponding rail 62 under its own power. Attached to each crane trolley 66 is a cradle assembly 70 the construction and operation of which will be discussed in further detail below.

The various components used to power and control the system 10 are preferably housed within shipping containers 90 supported on the launching platform 20. See FIGS. 7 and 8. In a preferred embodiment, standard shipping containers of the type that can be connected to conventional tractor-trailer arrangements for over-the-road transport are preferably used. It will be appreciated that such containers 90 typically comprise a rectangularly-shaped enclosure that has hinged access doors attached to the rear end or sides thereof. Such containers 90 also typically have tandem wheels 92 and/or dual axles and a fifth wheel for attachment to a standard truck tractor. These preferred containers are also of the type that are commonly shipped on ocean-going vessels. However, the skilled artisan will readily appreciate that the superstructure 30 of the launching platform 20 may be modified to accommodate a variety of other "mobile containers".

The top panel 91 of each container 90 is preferably equipped with lifting hooks 92 that enable the container 90 to be lifted onto the launching platform superstructure 30 by a mobile crane or other lifting mechanism (not shown). While the Figures depict four containers 90 supported on the superstructure 30, other numbers and arrangements of containers 90 could be successfully employed by altering the configuration of the superstructure 30 to accommodate such arrangements. Also, if the containers 90 are to be arranged in a stacked configuration, they can be equipped with conventional fastener apparatus (not shown) for selectively securing them together during mining operations and on-site relocation of the launching platform 20.

Figure 6:
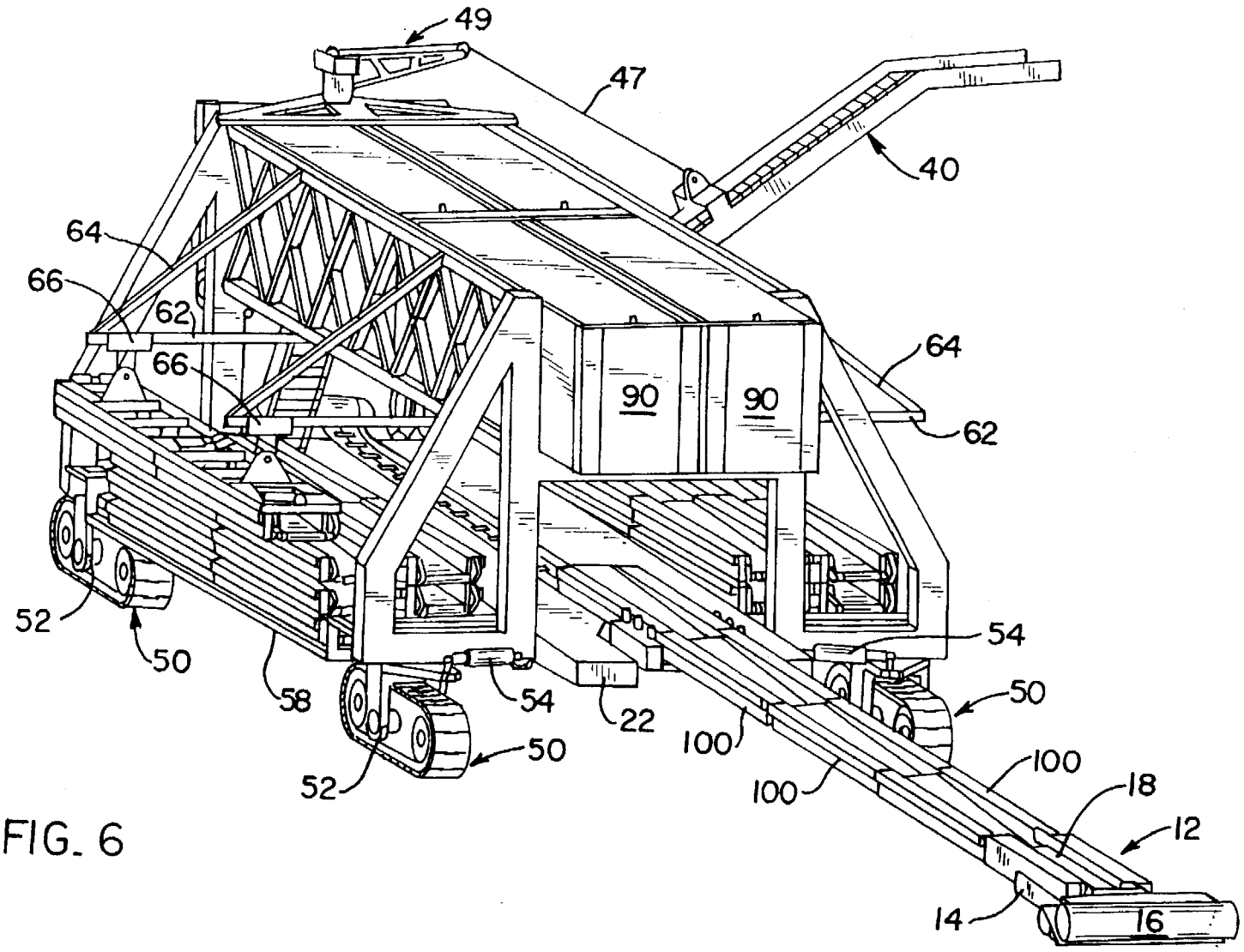
FIG. 6 is a front perspective view of the highwall mining system of FIG. 5.
Figure 7:
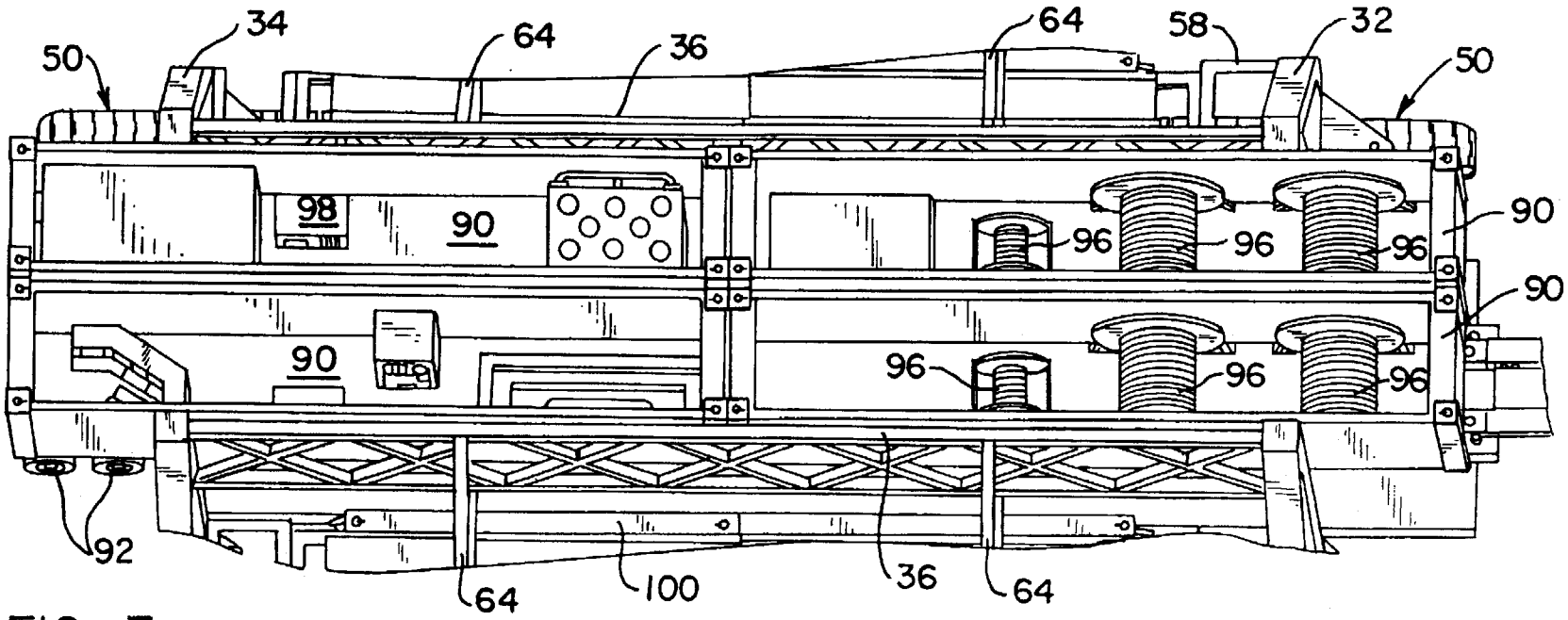
FIG. 7 is a partial perspective view of a preferred launching platform of the present invention with the upper panels of the containers removed for illustrative purposes.
Figure 8:
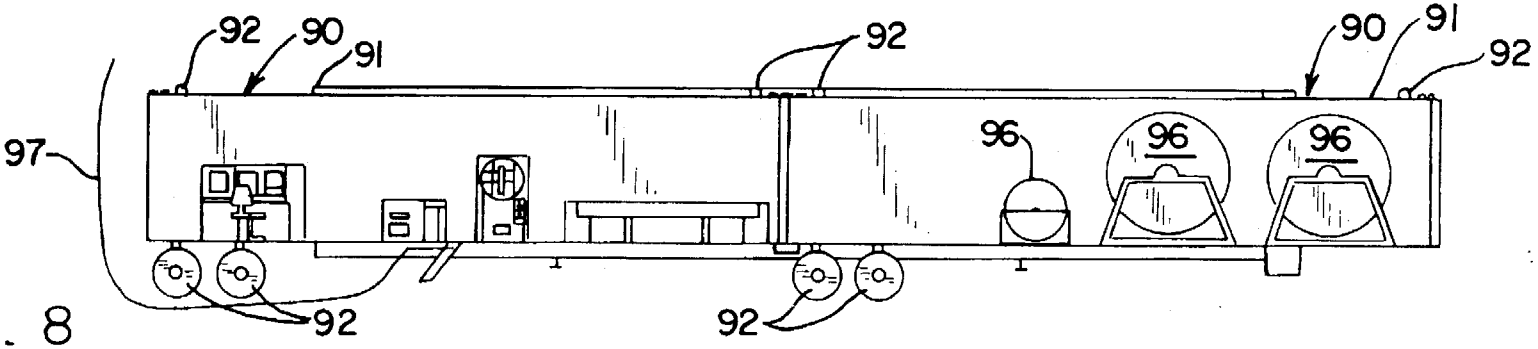
FIG. 8 is a cross-sectional side elevational view of two of the containers depicted in FIG. 7.

In a preferred embodiment, four containers 90 are arranged on the superstructure 30 as shown in FIG. 7. Preferably, each shipping container 90 houses various operational components of the system 10 such as, for example, hydraulic and electrical power units (92, 94), control consoles (not shown), and cable reels 96 for storing the power and control cables that distribute power to the mining machine 12 and conveyor cars 100. It will be appreciated that the cables extend through openings (not shown) in the containers 90 to be attached to the various components of the system 10. Preferably, depending upon the climate in which the system is intended to operate, each container 90 may be equipped with conventional space heating or cooling apparatuses depicted as 98 to maintain a temperature within the containers 90 that is compatible with the operating climate and the various components housed therein. In addition, each container 90 may be equipped with conventional air filtration devices (not shown) for preventing dust created by the mining operations from entering the containers 90. Each container 90 may also be equipped with conventional fire suppression systems (not shown). To access the components in each container, access steps 93 are preferably mounted to the rear of the deck 22 as shown in FIG. 6.

Figure 9:
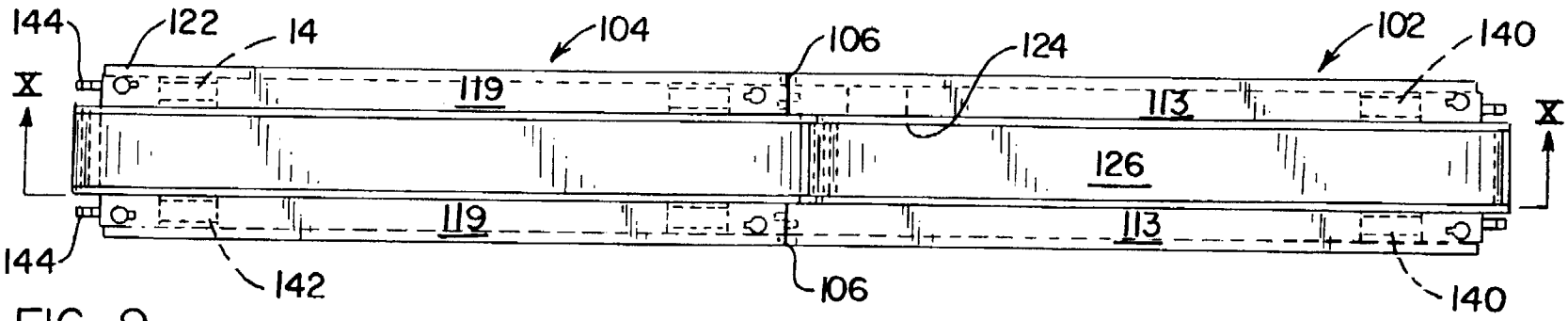
FIG. 9 is a plan view of a preferred conveyor car of the present invention.
Figure 10:
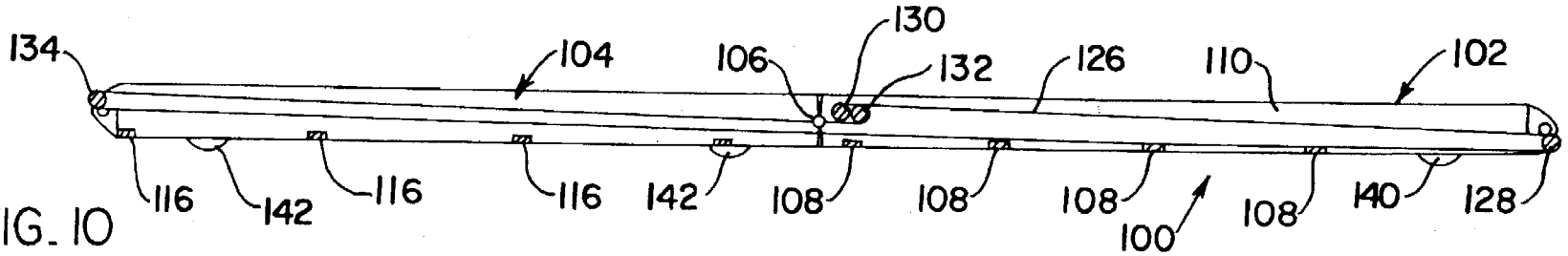
FIG. 10 is a cross-sectional elevational view of a preferred conveyor car of the subject invention taken along line X—X of FIG. 9.
Figure 11:
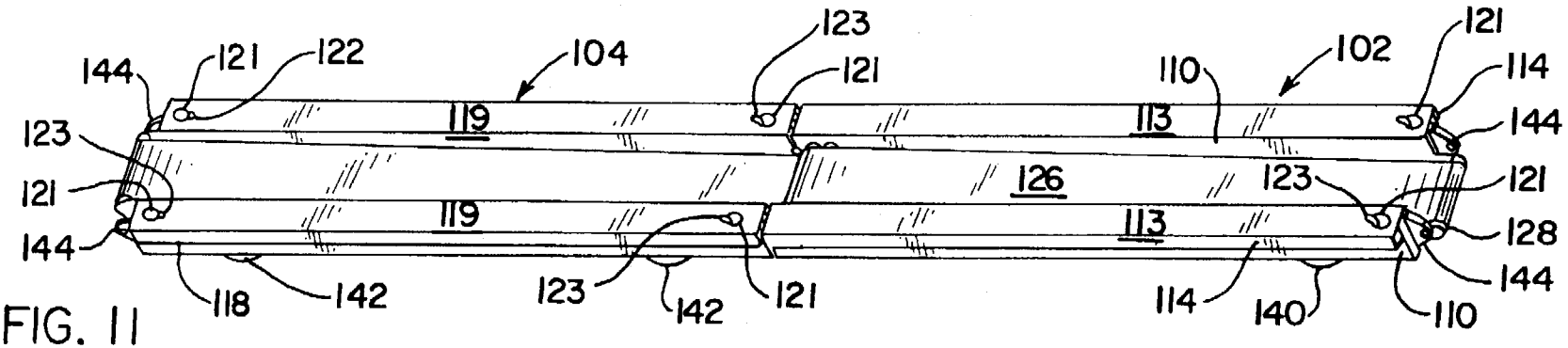
FIG. 11 is a perspective view of the conveyor car of FIGS. 9 and 10.

The preferred conveyor cars 100 employed by the present invention are shown in FIGS. 9–11. As can be seen in those Figures, each conveyor car 100 comprises a front frame portion 102 and a rear frame portion 104 that is pivotally attached to the front portion 102 by pins 106. The reader will appreciate that by pivotally interconnecting the front and rear conveyor portions (102, 104), the conveyor can pivot vertically in response to undulations in the mine floor. It will be further appreciated that such arrangement maintains the rear portion 104 in horizontal alignment with the front portion 102. Preferably, each conveyor car 100 is at least 15 meters long; however, those of ordinary skill in the art will appreciate that longer or shorter conveyor cars 100 can also be employed.

The front frame portion 102 is preferably fabricated from steel tubing and includes bottom bracing members 108 and two upstanding side members 110 that are attached to the bottom bracing members 108 to form a longitudinal trough 112. Each side member 110 has a relatively flat upper portion 113 and an outwardly extending guide portion 114 for assisting in guiding the conveyor car 100 in a manner that will be discussed in detail below. The rear frame portion 104 is similarly constructed. In particular, the rear frame portion 104 includes a bottom member 116 and two upstanding side members 118 that are interconnected in a spaced-apart relationship by bottom braces 116 to form a longitudinally extending trough 120. Each side member 118 has a relatively flat upper portion 119 and an outwardly extending guide portion 122 for assisting in guiding the conveyor car 100.

The front and rear frame portions (102, 104) are pivotally interconnected together by pins 106 as shown in FIG. 10. The skilled artisan will appreciate that, when pivotally interconnected together, the front and rear frame portions (102, 104) define an elongated trough 124 adapted to support an endless belt therein 126. Those of ordinary skill in the art will further appreciate, however, that the conveyors may, in the alternative, be quipped with other conveying means such as, for example, an endless chain conveyor of the type and construction described hereinabove.

As can be seen in FIGS. 9–11, the endless belt 126 is trained on rollers (128, 130, 132) operably mounted to the front frame portion 102 and a tail roller 134 mounted to the rear frame portion 104. Roller 130 is powered by a conventional electric motor (not shown) and serves to drive the endless belt 126 in an orbit within trough 124 to cause the coal that is deposited on the belt 126 to be transferred to the rear of the conveyor car 100 and ultimately deposited on another conveyor car 100 attached thereto or onto the deck conveyor 26. Roller 132 is a transition roller for maintaining the proper tension in the endless belt member 126. In a preferred embodiment, the front portion 102 is supported by a pair of free-wheeling ground engaging wheels 140 and the rear portion is preferably equipped with four free-wheeling ground engaging wheels 142. Coupling members 144 are attached to the front and rear frame portions (102, 104) to enable the conveyor cars 100 to be pivotally interconnected together to form a conveyor train 101.

Figure 12:
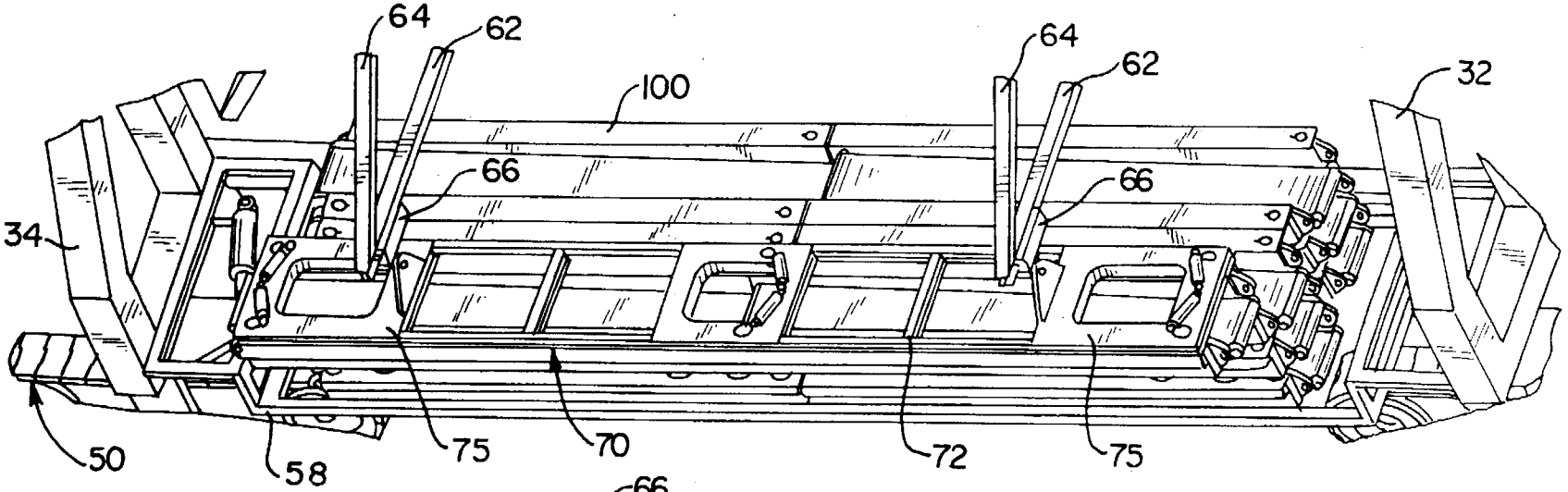
FIG. 12 is a partial perspective view of preferred crane and cradle assemblies attached to a preferred conveyor car of the present invention.
Figure 13:
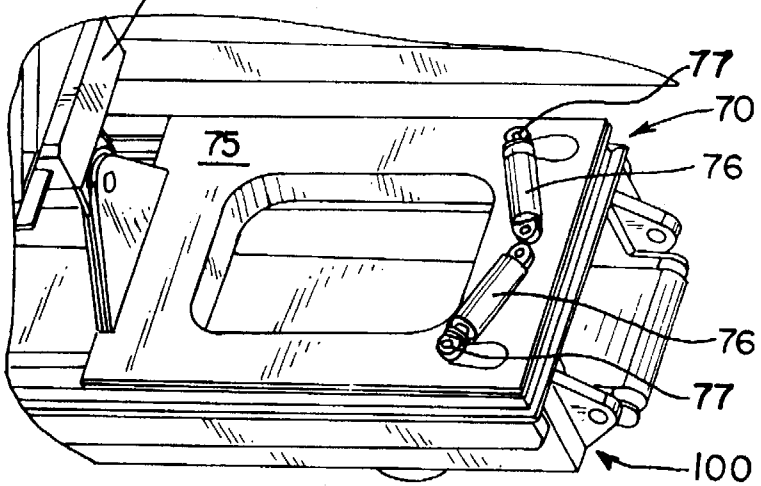
FIG. 13 is a partial assembly view of a preferred cradle attached to a preferred conveyor car of the present invention.
Figure 14:
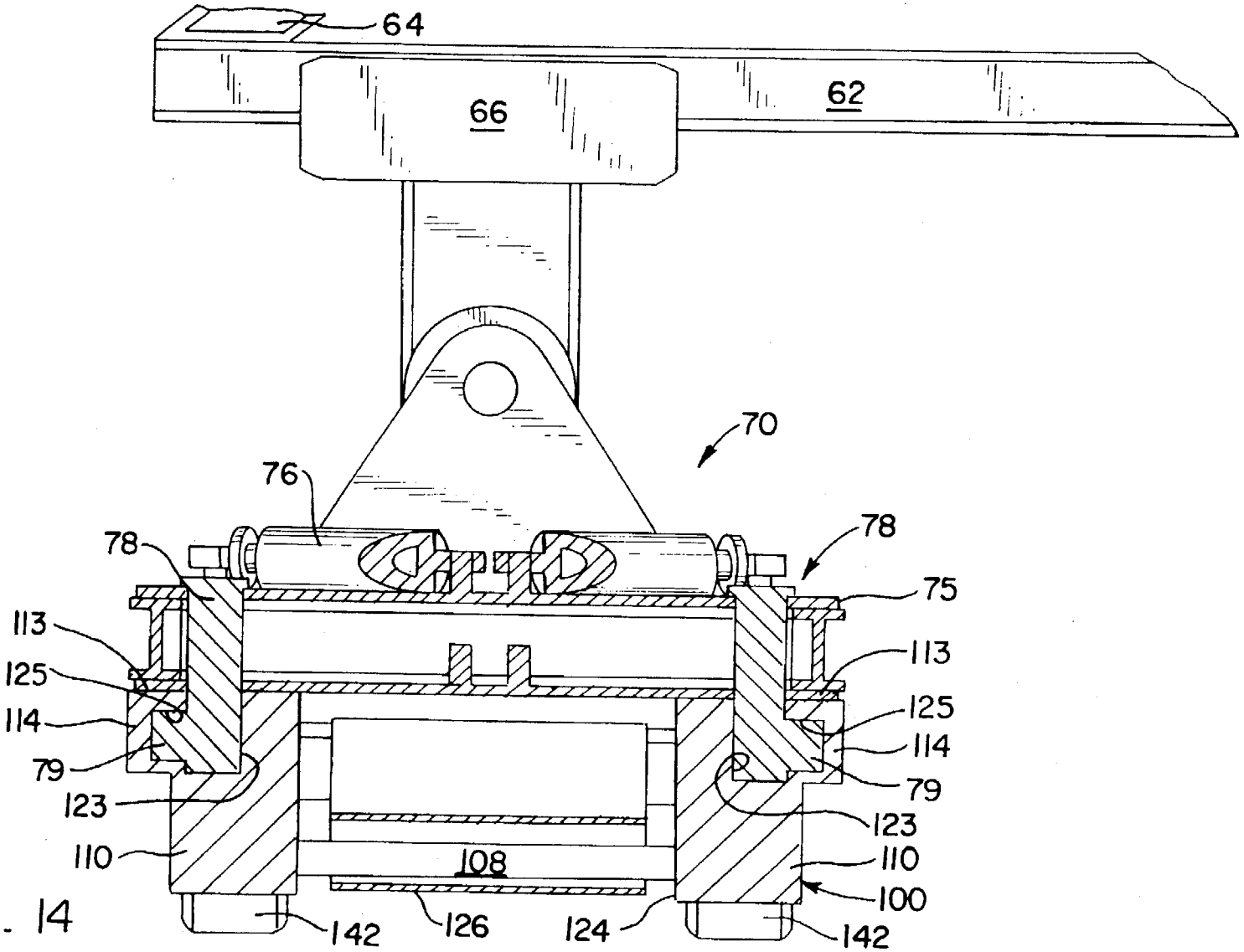
FIG. 14 is a partial cross-sectional view of a preferred cradle supporting a preferred conveyor car.

As mentioned above, in a preferred embodiment, a cradle assembly 70 is attached to each crane trolley 66 for selectively retrieving a conveyor 100 from the support member 58 and placing it onto the deck 22 where it can be attached to a preceding conveyor 100 that is attached to the conveyor train 101. As can be seen in FIGS. 12–14, a preferred cradle assembly 70 comprises a frame member 72 that is sized to extend the entire length of a conveyor 100. Three attachment assemblies 74 are attached to the frame 72 as shown in FIG. 12. Each attachment assembly 72 includes an upper plate member 75 that has two lock cylinders 76 mounted thereon. Each lock cylinder 76 selectively controls the rotation of a locking pin 78 that is attached to the end of an extendable piston 77 received in each cylinder 76. As can be most particularly seen in FIG. 14, a retaining key 79 is formed on the bottom portion of each lacking pin 78.

The subject cradle assembly 70 is designed to engage holes 121 formed in the front and rear conveyor portions (102, 104) of a conveyor 100. As can be seen in FIGS. 9 and 11, holes 121 are provided in the upper surfaces (113, 118) of the front and rear conveyor portions (102, 104). A keyway 123 is formed in each hole 121 such that a corresponding locking pin 78 can be inserted therein. An undercut area 125 is formed adjacent the bottom of each hole 121 to receive a key 79 therein.

To retrieve a conveyor 100 that is staged on the support member 58, the crane trolleys 66 are positioned such that the cradle assembly 70 is aligned with the conveyor 100 and the locking pins 78 are aligned with corresponding holes 121 in the conveyor 100. The cradle assembly 70 is then lowered to engage the conveyor 100. After the cradle assembly 70 has been lowered on top of the conveyor 100 and the locking pins 78 are received in the corresponding holes 121, cylinders 76 are actuated to cause the locking pins 78 to rotate such that the keys 79 are received in the undercut areas 125. Thereafter, the crane trolleys 66 can be actuated to lift the cradle 70 and attached conveyor 100 and move it to a position on the deck 22 such that it can be attached to the last conveyor 100 in the conveying train 101.

Figure 18:
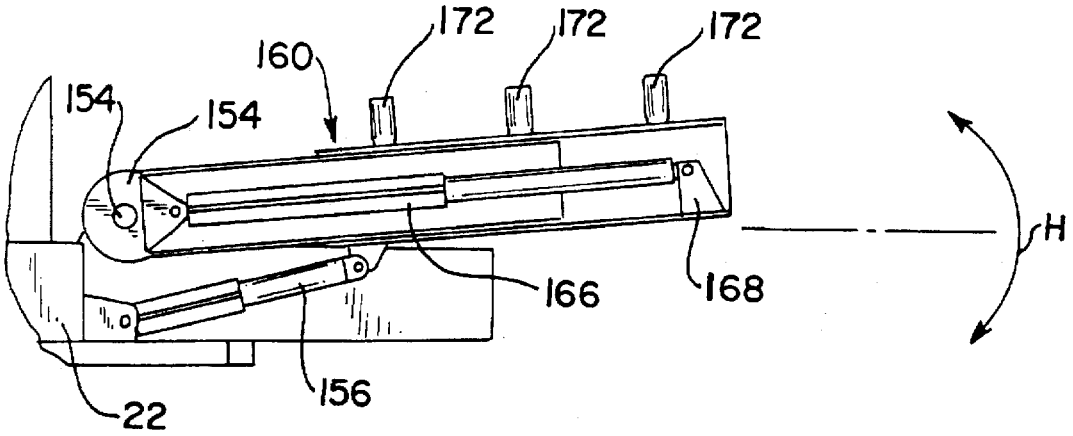
FIG. 18 is a cross-sectional view of the conveyor guidance assembly of the present invention taken along line XVIII—XVIII in FIG. 15 with some of the elements thereof shown in full view for clarity.
Figure 19:
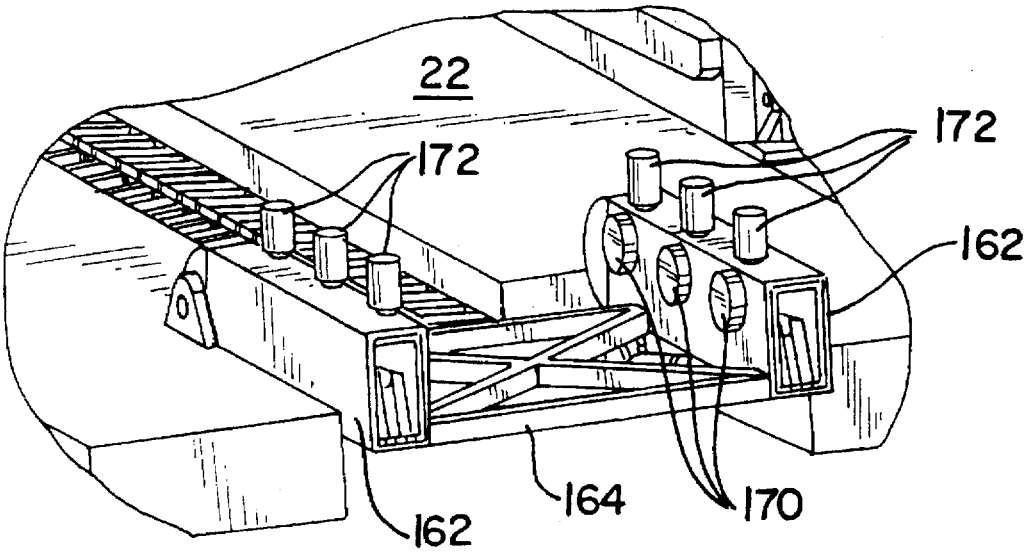
FIG. 19 is a partial perspective view of the conveyor guidance assembly of FIGS. 15–18 in a retracted position.
Figure 20:
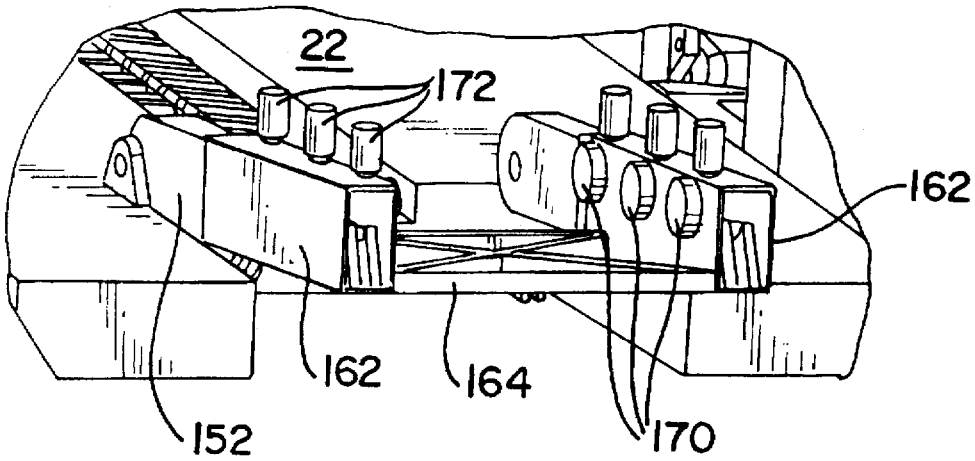
FIG. 20 is a partial perspective view of the conveyor guidance assembly of FIGS. 15–19 in a partially extended position.
Figure 21:
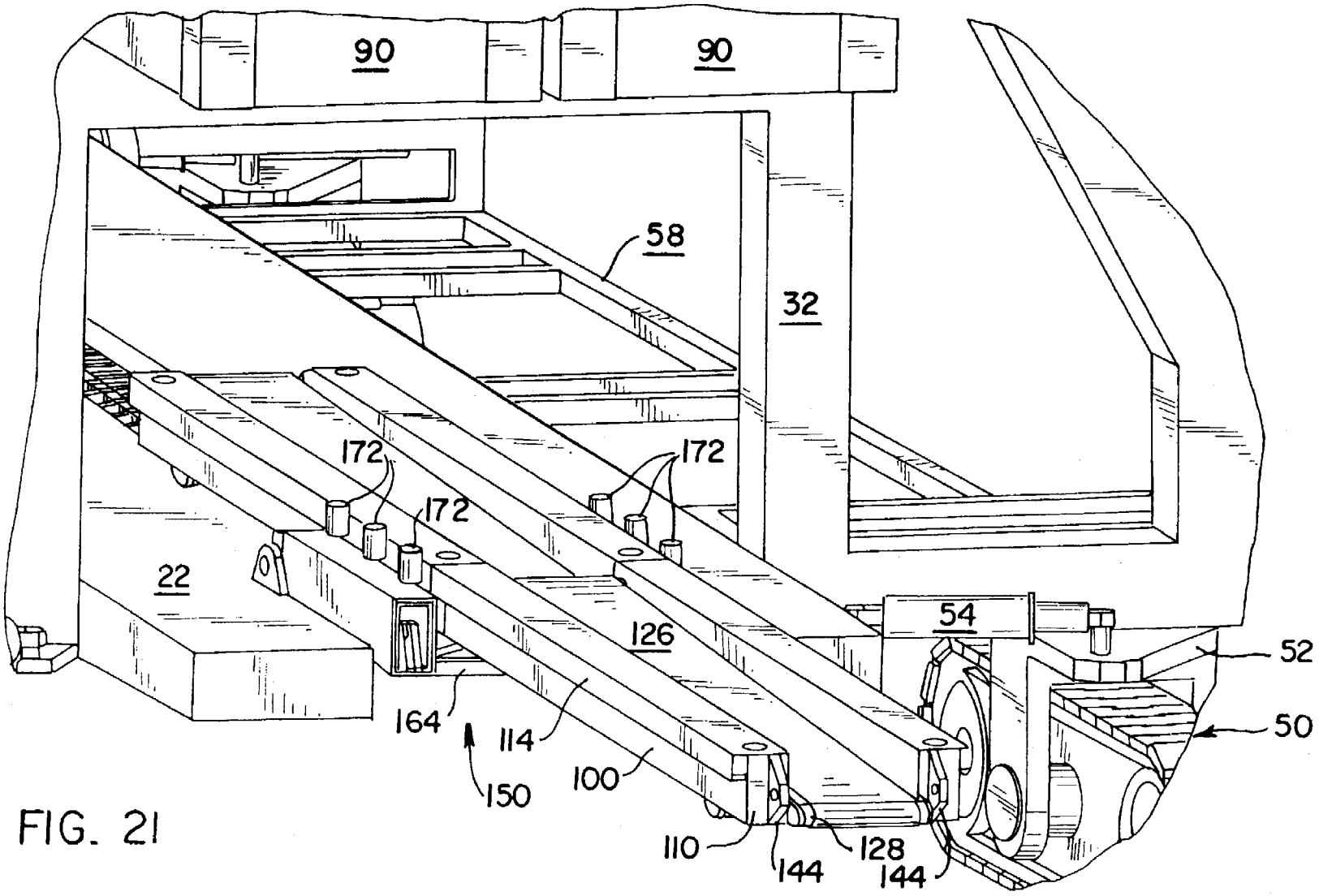
FIG. 21 is a partial perspective view of a preferred conveyor car supported on a preferred conveyor guidance assembly of the present invention.

In a preferred embodiment, launching platform 20 is equipped with a conveyor car guidance assembly, generally designated as 150. More particularly and with reference to FIGS. 13–16, the guidance assembly 150 preferably comprises a pair of spaced support arms 152 that are pivotally attached to the deck 22 by pins 154. A hydraulic cylinder 156 is attached between the deck 22 and each support arm 152 for selectively controlling the pivotal motion of the support arms 152 in an arcuate path (the "attack angle") designated by arrow "H" in FIG. 18. As will be discussed in further detail below, "attack angle" refers to the angle of orientation at which the support arms 152 can be pivoted.

The guidance assembly 150 also preferably includes a conveyor support frame 160 that is telescopically received on the support arms 152. The support frame 160, in a preferred embodiment, comprises two hollow side members 162 that are slidably received on the support arms 152. It will be appreciated that the bottom of each side member 162 has a slot therein (not shown) to provide clearance for the corresponding cylinder 156. A bottom support member 164 extends between the side members 162 and is rigidly attached thereto.

Figure 15:
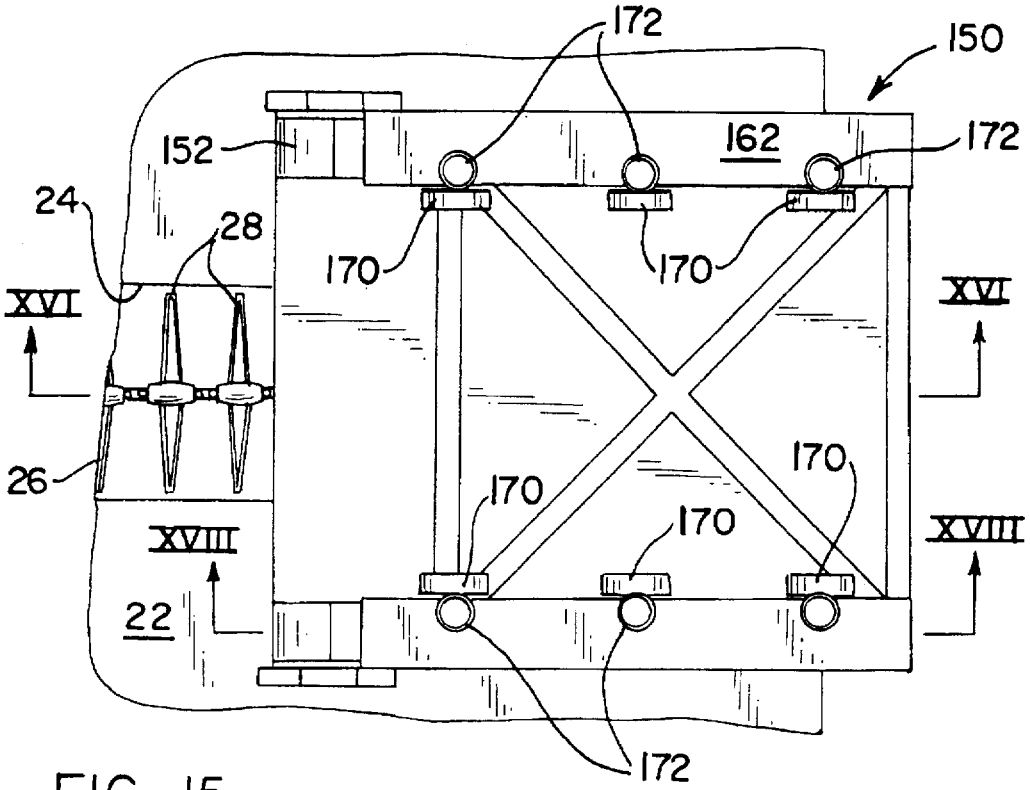
FIG. 15 is a plan view of a preferred conveyor guidance assembly of the present invention.
Figure 16:
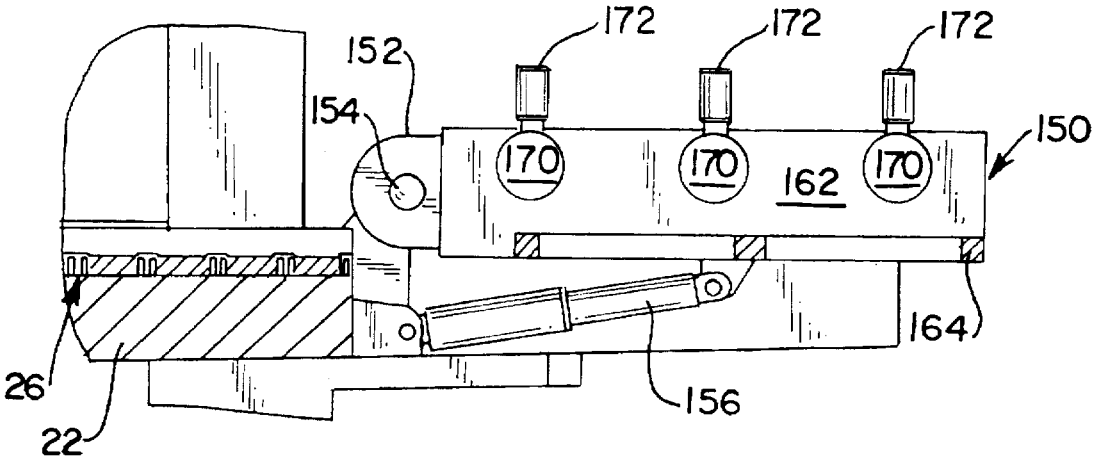
FIG. 16 is a cross-sectional view of a preferred conveyor guidance assembly of the present invention taken along line XVI—XVI in FIG. 15.
Figure 17:
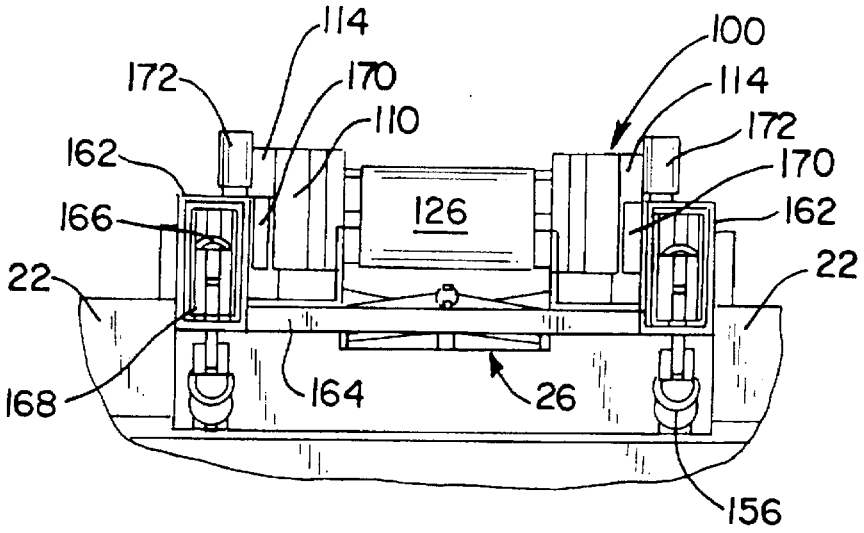
FIG. 17 is a partial end view of the conveyor guidance assembly of FIGS. 15 and 16 supporting a preferred conveyor car thereon.

The conveyor support frame 160 is preferably constructed to be selectively extended and retracted relative to the support arms 152 by cylinders 166 attached to each support arm. As can be seen in FIG. 15, a hydraulically powered cylinder 166 is attached to each support arm 152 and an attachment member 168 that is attached to the interior of each side member 162. The skilled artisan will appreciate that by selectively extending and retracting the pistons of these cylinders 166, the conveyor support frame 160 can be selectively extended and retracted relative to the front of the deck 22.

As can be seen in FIGS. 13–17, the conveyor support frame 160 is also equipped with a series of support rollers (170, 172). Preferably three support rollers 170 are attached to the inside surface of each side member 162 such that they can engage the corresponding guidance bars (114, 122) on the front and rear conveyor portions (102, 104), respectively of each conveyor car 100 to rollingly support the conveyor car 100 thereon. In addition, a series of three lateral support rollers 172 are attached to the top surface of each side member 162 to provide lateral support to the conveyor car 100 received thereon. Such arrangement permits material and debris that may accumulate on the conveyor cars 100 to fall to the ground below the front of the deck 22 and not on the deck 22 itself. The skilled artisan will appreciate that the conveyor guidance assembly 150 can be selectively pivoted and extended to guide the mining machine 12 and conveyor train 101 at a predetermined azimuth relative to the bench "A". It will also be appreciated that the guidance assembly 150 is also sized relative to various mining machine 12 components such that the mining machine 12 may be supported and guided thereby. It will be further appreciated that in an alternative embodiment, the entire deck member can be arranged with the above discussed guidance wheels and arranged to pivot relative to the launching platform superstructure. Such arrangement serves to guide the entire portion of the conveyor train that is received on the deck.

The operation of a preferred system 10 will now be described. After the bench "A" adjacent the highwall "B" has been prepared (i.e., leveled and graded) to accept the mining system 10, the system 10 is transported from a prior mining site to the bench "A". The system 10 components, in disassembled form, are transported to the new mining site on standard over-the-highway vehicles. When the components reach the site, they are unloaded and assembled in the manner described above utilizing conventional tools, cranes, etc. After the launching platform 20 has been assembled and the conveyor cars 100 are stacked on the lateral support members 58 on each side of the deck 22, the power and control cables are attached to the mining machine 12 so that it can be positioned on the deck 22 and guidance assembly 150 in a ready position. If the launching platform 20 is not already adjacent the highwall "B" such that mining can begin, it is moved by the track assemblies 50 until it is brought into such position.

After the launching platform 20 has been located adjacent the highwall B and exposed coal seam "C", the cylinders (156, 166) on the guidance assembly 150 are used to properly orient the mining machine 12 to an attack angle that substantially matches the angle at which the seam is located relative to the bench. A first conveyor car 100 is retrieved from a stack of conveyor cars 100 by the crane assemblies 160 and positioned such that it is aligned with the deck conveyor 24 and its front frame portion 102 is adjacent the rear of the mining machine 12. The conveyor car 100 is then pinned to the mining machine 12 and the power cables for powering the conveyor car's drive motor are attached to the mining machine 12. The mining machine 12 and attached conveyor car 100 is provided with power and the mining process is commenced. Power is also supplied to conveyors (26, 40). As the mining machine 12 enters the seam "C", it dislodges the coal and discharges such won coal onto the conveyor cars 100 attached thereto. The conveyor cars 100 discharge the coal onto the deck conveyor 26 which ultimately discharges it onto the stacker conveyor 40. The stacker conveyor 40 either discharges the coal into a haulage vehicle arranged thereunder or discharges it into a pile adjacent the launching platform 20 for removal at a later time.

As the mining proceeds, additional conveyor cars 100 are added in the following manner. After the last conveyor car 100 in the train 101 has advanced on the deck 22 to a point where another conveyor car 100 can be added, the mining process is interrupted and an additional conveyor car 100 is mechanically attached to the last conveyor car 100 in the conveyor train 101. In particular, the attachment members 144 on each car 100 are aligned such that pins can be extended therethrough. The power cable for the newly added conveyor car 100 is then wired to the preceding conveyor car 100 to enable electrical power to be supplied to the newly added car 100. After the new conveyor car 100 has been pinned to the prior car 100 and its power cables have also been coupled to the power system of the prior car 100, the mining process is continued.

After the mining machine 12 has mined desired distance, the mining machine 12 is reversed such that it pushes the conveyor train 101 out of the mined hole. The conveyor cars 100 are then detached from the train 101 and restacked on the launching platform 20 until the mining machine 12 is again staged on the platform 20. The platform 20 is then moved by virtue of the track assemblies 50 to a new position adjacent the previously mined hole and the entire process is repeated. After mining has been completed at that site the various components of the system 10 are disassemble for shipping to a new location.

Those of ordinary skill in the art will appreciate that the present invention provides great advantages over other highwall mining systems. In particular, the subject invention is designed such that it can be shipped from mine site to mine site utilizing standard over-the-road vehicles. Thus, the present invention reduces the amount of transportation costs typically associated with transporting conventional highwall mining apparatuses from site to site. The subject invention also provides a means for accurately aligning a mining machine and conveying train with a seam. The subject invention also serves to guide the mining machine and conveying train as it progressively mines the seam. While the subject invention provides these and other advantages over other highwall mining systems, it will be understood, however, that various changes in the details, materials and arrangements of parts which have been herein described and illustrated in order to explain the nature of the invention may be made by those skilled in the art within the principle and scope of the invention as expressed in the appended claims.

What is claimed is:

1. Apparatus for mining aggregate material from a partially exposed seam adjacent a bench on a surface mine and extending from said bench at an elevation and angle relative thereto, the apparatus comprising:

a self-propelled mining means for dislodging aggregate material from said seam;

conveying means attached to said self-propelled mining means for conveying said dislodged material to a location remote from said seam;

a deck member supportable on said bench;

a support assembly sized to engage and guide said self-propelled mining means and each said conveying means as said mining means and each said conveying means enter the seam, said support assembly being attached to said deck member such that said support assembly can be selectively pivoted and extended and retracted relative to said deck member; and pivot means attached to said deck and said support assembly for selectively orienting said support assembly to a predetermined attack angle that corresponds to said seam angle.

2. The apparatus of claim 1 further comprising extension means attached to said deck and said support assembly for selectively extending and retracting said support assembly.

3. The apparatus of claim 1 wherein said support assembly has at least one opening therethrough to permit aggregate material falling thereon to pass therethrough.

4. The apparatus of claim 1 further comprising transportation means attached to said deck member for moving said deck member on said bench to a predetermined location adjacent said partially exposed seam.

5. The apparatus of claim 1 further comprising a stacker conveyor pivotally attached to said deck member and adapted to be selectively pivoted to positions adjacent each lateral side of said deck member, said stacker conveyor constructed to receive said dislodged material from said deck conveyor and selectively elevate said dislodged material above said adjacent positions for discharge at a second remote location adjacent said deck member.

6. The apparatus of claim 1 further comprising:

an overhead frame assembly attached to said deck member; and at least one enclosure supported on said overhead frame assembly for housing therein means for supplying control power to said mining means and conveying means.

7. The apparatus of claim 6 wherein each said enclosure comprises a wheeled container member adapted for attachment to a mobile vehicle.

8. The apparatus of claim 1 wherein said conveying means comprises a plurality of interconnectable conveyor units.

9. The apparatus of claim 8 wherein each said conveyor unit comprises:

a first wheeled frame member;

a second wheeled frame member pivotally interconnected to said first wheeled frame member and cooperating therewith to form an elongated conveyor trough; and an endless driven conveying member operably supported in said elongated trough.

10. The apparatus of claim 8 further comprising overhead crane means attached to said deck member for selectively retrieving an interconnectable conveyor unit staged adjacent said deck member and placing said interconnectable conveyor unit on said deck member for interconnection with a prior interconnectable conveyor unit received on said deck member.

11. The apparatus of claim 8 further comprising means attached to said deck member for staging a plurality of interconnectable conveyor units thereon.

12. The apparatus of claim 1 further comprising a deck conveyor operably supported on said deck, said deck conveyor receiving said dislodged aggregate material from said conveying means and conveying said dislodged material to a remote location.

13. A launching platform for operably supporting and guiding a self-propelled mining machine and accompanying string of conveyors used to mine aggregate material from a partially exposed seam that is adjacent a bench on a surface mine and which extends from said bench at an elevation and angle relative thereto, the launching platform comprising:

a deck member supportable on said bench;

a support assembly pivotally attached to said deck member for selectively orienting said self-propelled mining machine and accompanying string of conveyors to a predetermined attack angle that corresponds to said seam angle;

extension means attached to said deck and said support assembly for selectively extending and retracting said support assembly relative to said deck; and pivot means attached to said deck and said support assembly for selectively pivoting said support assembly to said predetermined attack angle.

14. The apparatus of claim 13 wherein said support assembly has at least one opening therethrough to permit aggregate material falling thereon to pass therethrough.

15. The apparatus of claim 13 further comprising transportation means attached to said deck member for moving said deck member on said bench to a predetermined location adjacent said partially exposed seam.

16. The apparatus of claim 13 further comprising a stacker conveyor pivotally attached to said deck member and adapted to be selectively pivoted to positions adjacent each lateral side of said deck member, said stacker conveyor constructed to receive said dislodged material from said deck conveyor and selectively elevate said dislodged material above said bench for discharge at a second remote location adjacent said deck member.

17. The apparatus of claim 13 further comprising:

an overhead frame assembly attached to said deck member; and at least one enclosure supported on said overhead frame assembly for housing therein means for supplying control power to said mining means and conveying means.

18. The apparatus of claim 17 wherein each said enclosure comprises a wheeled container member adapted for attachment to a mobile vehicle.

19. The apparatus of claim 13 further comprising overhead crane means attached to said deck member for selectively retrieving a conveyor unit staged adjacent said deck member and placing said conveyor unit on said deck member for interconnection with a prior conveyor unit received on said deck member to form said conveyor train.

20. The apparatus of claim 13 further comprising means attached to said deck member for staging a plurality of conveyor units that; when interconnected, form said train of conveyors.

21. The apparatus of claim 13 further comprising a deck conveyor operably supported on said deck, said deck conveyor receiving said dislodged aggregate material from said conveying means and conveying said dislodged material to a remote location.

* * * * *